US010111283B2

(12) United States Patent
Karch et al.

(10) Patent No.: US 10,111,283 B2
(45) Date of Patent: Oct. 23, 2018

(54) ACTIVE TEMPERATURE CONTROL FOR INDUCTION HEATING

(71) Applicants: Airbus SAS, Blagnac (FR); Airbus Operations GmbH, Hamburg (DE)

(72) Inventors: Christian Karch, Neubiberg (DE); Juergen Steinwandel, Uhldingen-Muehlhofen (DE); Heiko Fietzek, Bernau am Chiemsee (DE); Paulin Fideu, Hamburg (DE); Bernard Duprieu, Hamburg (DE)

(73) Assignees: AIRBUS OPERATIONS GMBH, Hamburg (DE); AIRBUS SAS, Blagnac (FR)

( * ) Notice: Subject to any disclaimer, the term of this patent is extended or adjusted under 35 U.S.C. 154(b) by 615 days.

(21) Appl. No.: 14/470,157

(22) Filed: Aug. 27, 2014

(65) Prior Publication Data

US 2015/0060437 A1 Mar. 5, 2015

(30) Foreign Application Priority Data

Aug. 29, 2013 (EP) ..... 13182142

(51) Int. Cl.
*H05B 6/06* (2006.01)
*H05B 6/10* (2006.01)

(52) U.S. Cl.
CPC ..... *H05B 6/06* (2013.01); *H05B 6/105* (2013.01); *H05B 2206/023* (2013.01)

(58) Field of Classification Search
CPC ..... H05B 2206/023; H05B 6/105; H05B 6/06
(Continued)

(56) References Cited

U.S. PATENT DOCUMENTS 5,568,240 A 10/1996 Ohtsuka
5,778,293 A 7/1998 Ohtsuka
(Continued)

FOREIGN PATENT DOCUMENTS

EP 0649072 4/1995

OTHER PUBLICATIONS

European Search Report, dated Nov. 14, 2013.

*Primary Examiner* — Dana Ross
*Assistant Examiner* — Kuangyue Chen
(74) *Attorney, Agent, or Firm* — Greer, Burns & Crain, Ltd.

(57) ABSTRACT

An induction heating system and a method for controlling a process temperature for induction heating of a workpiece. The induction heating system comprises an inductor configured to generate an alternating magnetic field in response to an alternating current supplied thereto, a magnetic load comprising a magnetic material, the magnetic material having a Curie temperature and being configured to generate heat in response to the alternating magnetic field being applied thereto, the magnetic load being connectable to the workpiece in a heat-conducting manner so as to transfer the generated heat to the workpiece, and a control unit configured to control the process temperature for manufacturing the workpiece by adjusting the alternating magnetic field when the temperature of the magnetic material is in a temperature control range around or below the Curie temperature of the magnetic material, the temperature control range being dependent on the magnetic material of the magnetic load.

19 Claims, 8 Drawing Sheets

1

(58) Field of Classification Search
USPC ..... 219/634, 600, 618
See application file for complete search history.

(56) References Cited

U.S. PATENT DOCUMENTS

| | | | | |
|---|---|---|---|---|
| 6,528,771 | B1 | 3/2003 | Matsen et al. | |
| 2001/0007323 | A1* | 7/2001 | Clothier | H05B 6/06 219/621 |
| 2006/0218936 | A1* | 10/2006 | Kobayashi | F25B 21/00 62/3.1 |
| 2011/0057357 | A1* | 3/2011 | Feigenblum | B29C 33/06 264/403 |
| 2012/0145703 | A1 | 6/2012 | Matsen et al. | |

* cited by examiner

ACTIVE TEMPERATURE CONTROL FOR INDUCTION HEATING

CROSS-REFERENCES TO RELATED APPLICATIONS

This application claims the benefit of the European patent application No. 13182142.3 filed on Aug. 29, 2013, the entire disclosures of which are incorporated herein by way of reference.

BACKGROUND OF THE INVENTION

The present invention generally relates to induction heating. More particularly, the present invention relates to an induction heating system and a method for controlling a process temperature for induction heating of a workpiece.

Induction heating may be used in multiple different manufacturing processes or steps, e.g., to bond, to cure, to harden or soften metals or other conductive or non-conductive materials.

In a basic induction heating setup, a power supply provides and sends an alternating current to and through an inductor. The inductor is often formed as a coil, for example, a copper coil. In induction heating, typically, a source of high frequency electricity is used to drive an alternating current through such a coil. This coil is often referred to as induction coil or work coil. The passage of current through this coil generates a changing magnetic field (which may be referred to as an alternating magnetic field) in the space within and around the work coil. Depending on the applied alternating current, the magnetic field may be (very) intense and rapidly changing.

In case of direct induction heating, a workpiece to be heated can be placed within this (intense) alternating magnetic field. Such direct induction heating works with conductive materials like metals. Plastics and other non-conductive materials can be heated indirectly by first heating a conductive (metal) susceptor which transfers generated heat to the non-conductive material. In this case, the susceptor to be heated can be placed within the (intense) alternating magnetic field and the heat generated by the susceptor can then be transferred to the non-conductive workpiece.

In direct induction heating, the heating of the workpiece can be referred to as a non-contact heating process. In indirect induction heating, the heating of the susceptor (load) can be referred to as a non-contact heating process. Since it is non-contact, the heating process does not contaminate the material being heated (either the workpiece or the susceptor). It is also very efficient since the heat is actually generated inside the workpiece (direct heating) or the susceptor (indirect heating).

In case of the workpiece being conductive, the alternating magnetic field induces a current flow in the conductive workpiece. The induced current(s) is/are normally known as eddy current(s). When the workpiece is a metal part, (circulating) eddy currents are induced within the part by means of the magnetic field. These eddy currents flow against the electrical resistivity of the metal, generating precise and localized heat without any direct contact between the part and the inductor. This heating occurs with both magnetic and non-magnetic parts, and is often referred to as the "Joule effect", referring to Joule's first law—a scientific formula expressing the relationship between heat produced by electrical current passed through a conductor.

For ferri- and ferromagnetic materials, e.g., ferrous metals like iron and some types of steel, there is an additional heating mechanism that takes place at the same time as the eddy currents mentioned above. The (intense) alternating magnetic field inside the work coil repeatedly magnetizes and de-magnetizes such magnetic materials and thereby causes magnetic domains to change their direction. This (rapid) flipping of the magnetic domains causes considerable friction and thus produces heat inside the material. Heating due to this mechanism is known as hysteresis loss, hysteresis effect or, in short, hysteresis. In consequence, additional heat is produced within magnetic parts through hysteresis. The hysteresis effect can be a large contributing factor to the heat generated during induction heating, but only takes place inside ferri- and ferromagnetic materials, e.g., ferrous materials. For this reason, ferrous materials lend themselves more easily to heating by induction than non-ferrous materials. Thus, in view of the hysteresis effect, it is easier to heat magnetic materials.

To sum up the above: In addition to the heat induced by eddy currents, magnetic materials also produce heat through the hysteresis effect (described above). This effect ceases to occur at temperatures above the so-called "Curie" point or Curie temperature—the temperature at which a magnetic material loses its ferri- or ferromagnetic properties and becomes paramagnetic. For example, steel loses its ferromagnetic properties when heated above approximately 700° C. This temperature is known as the Curie temperature of steel. This means that above 700° C. there can be no heating of the material due to hysteresis losses. Any further heating of the material must be due to induced eddy currents alone or possible other effects.

In the manufacturing lines for carbon-fiber-reinforced polymer (CFRP) workpieces (CFRP is also sometimes referred to as carbon-fiber-reinforced plastic or carbon-fiber reinforced thermoplastic or often simply carbon fiber and sometimes abbreviated as CRP or CFRTP), one crucial point is the process temperature control and temperature management. Fur curing processes, for example, it is required that the temperature distribution within the CFRP component is nearly uniform. Moreover, the local temperatures should not exceed a critical temperature which would lead to irreversible damage or should not undershoot temperatures which are not sufficient for a reliable curing process. The heating of CFRP components is usually achieved by autoclave convection heating or by direct heating using resistance heating elements or fluid elements. However, these methods do not generally guarantee uniform volume heating.

Induction heating systems based on ferri- and ferromagnetic magnetic materials are, in principle, available but their application to the curing process of composites is limited due to loss mechanisms in magnetic materials and therefore due to the difficulty to control the temperature field.

One attempt to apply indirect induction heating to a part is described in U.S. Pat. No. 6,528,771 B1. U.S. Pat. No. 6,528,771 B1 relates to an induction heating system for fabricating a part by heating and forming the part and a method for controlling an induction heating process. The induction heating system comprises: a susceptor including a susceptor material defining a cavity configured to receive the part, a coil positioned in proximity to the susceptor, and a temperature controller having a power supply and a controlling element. Said susceptor material is configured to respond to electromagnetic flux applied thereto by generating heat so as to increase a temperature of the part in the cavity. The coil is capable of generating the electromagnetic flux when supplied electrical power. Said power supply is operably connected to the coil to supply an amount of the electrical power thereto. Said controlling element is configured to measure trends in output of the power supply and further configured to change the amount of electrical power being supplied so as to control the temperature of the part in the cavity during fabrication based upon the measured trends. U.S. Pat. No. 6,528,771 B1 describes a fixed range of temperature control over a 20° F. window around the Curie temperature.

Accordingly, there is a need for a flexible technique for controlling a process temperature for induction heating of a workpiece.

SUMMARY OF THE INVENTION

According to a first aspect, an induction heating system for controlling a process temperature for induction heating of a workpiece is provided. The induction heating system comprises an inductor, a magnetic load and a control unit. The inductor is configured to generate an alternating magnetic field in response to an alternating current (being) supplied thereto (i.e., to the inductor). The magnetic load comprises a magnetic material. The magnetic material has a Curie temperature and is configured to generate heat in response to the alternating magnetic field (being) applied thereto (i.e., to the magnetic material). The magnetic load is connectable to the workpiece in a heat-conducting manner so as to transfer the generated heat to the workpiece. The control unit is configured to control the process temperature by adjusting the alternating magnetic field when the temperature of the magnetic material is in a temperature control range around or below the Curie temperature of the magnetic material. The temperature control range is dependent on the magnetic material of the magnetic load.

The temperature control range may be regarded as a temperature range around the Curie temperature of the magnetic material. In this context, the term around the Curie temperature may be understood to mean any temperature range comprising the Curie temperature. For example, the temperature control range may comprise a first temperature control range below the Curie temperature and a second temperature control range above and/or including the Curie temperature. The first temperature control range and the second temperature control range may have the same or a different size. The second temperature range may only be or comprise the Curie temperature or may be or comprise a temperature range including the Curie temperature.

Alternatively, the temperature control range may be a temperature range below the Curie temperature. According to this alternative, the Curie temperature may be above the end point of the temperature control range. For example, the temperature control range may be a temperature range from a starting point below the Curie temperature up to an end point below the Curie temperature.

The temperature control range may be regarded as being dependent on at least one of the type of the magnetic material and properties of the magnetic material. In this way, the control unit may adjust the temperature control range in dependence of the magnetic material, e.g., in dependence of the type of the magnetic material and/or the properties of the magnetic material. For example, a first temperature control range may be used for a first (type of) magnetic material and a second temperature control range, different from the first temperature control range, may be used for a second (type of) magnetic material, the second (type of) magnetic material being different from the first (type of) magnetic material.

The properties of the magnetic material may be or comprise the magnetic permeability (susceptibility) of the magnetic material and/or the change of the magnetic permeability (susceptibility) of the magnetic material over temperature. For example, the properties of the magnetic material may be or comprise the drop in magnetic permeability (drop in susceptibility) over temperature. In the latter case, the temperature control range may be adjusted in dependence of the abruptness of the drop in magnetic permeability (susceptibility) over temperature of the magnetic material being used. For example, in case of a first (steep) drop in magnetic permeability (susceptibility) over temperature of the magnetic material from an at least almost constant starting temperature to an at least almost constant end temperature, the temperature control range may have a first size. In case of a second (flat; at least flatter than the first drop) drop in magnetic permeability (susceptibility) over temperature of the magnetic material from an at least almost constant starting temperature to an at least almost constant end temperature, the temperature control range may have a second size, the second size being larger than the first size.

The temperature control range may be regarded as the range in which the change of the magnetic permeability (susceptibility) over temperature is higher than a predetermined value. For example, the magnetic permeability of ferri- and ferromagnetic materials at a starting temperature usually remains at least almost constant with increasing temperature until it starts to drop (decrease). When the magnetic permeability (susceptibility) starts to drop (is not anymore at least almost constant), the temperature control range may start. With increasing temperature, the magnetic permeability (susceptibility) typically further drops up to and over the Curie temperature until it reaches an end temperature, at which the magnetic permeability (susceptibility) remains at least almost constant even if the temperature is further increased. The temperature, at which the end temperature is reached, may be regarded as the end point of the temperature control range.

The control unit may be configured to control the process temperature by adjusting the alternating magnetic field only when the temperature of the magnetic material is in the temperature control range around or below the Curie temperature of the magnetic material. When the temperature of the magnetic material is outside of the temperature control range, e.g., higher or lower than the lower and upper ranges of the temperature control range, the control unit may be configured to refrain from controlling the process temperature.

The control unit may be configured to determine which level or amount of the alternating magnetic field is necessary in order to heat the magnetic material to a temperature within the temperature control range around or below its Curie temperature. After determining the necessary level or amount, the control unit may set the alternating magnetic field to the necessary level or amount so that the alternating magnetic field is applied to the magnetic material with the necessary level or amount. In differentiation to other techniques, the magnetic material does not undesirably reach its Curie temperature. Rather, the magnetic material may be actively caused to maintain a temperature within the temperature control around or below its Curie temperature by actively controlling the alternating magnetic field, e.g., by actively setting the alternating magnetic field to a determined (necessary) level.

In general, when the magnetic material reaches a temperature above its Curie temperature, the generation of heat based on the hysteresis effect is at least reduced, if not completely vanished, resulting in a decrease in the amount of energy produced or generated by the magnetic material and thus the magnetic load. As a result, the amount of energy transferred to and absorbed by the workpiece, from the magnetic load, is reduced. If the magnetic load is electrically conductive, the remaining heat generated in the magnetic load is mainly due to eddy currents caused by the alternating magnetic field and thus flowing in the magnetic material. However, the remaining heat is lower than the heat generated before the magnetic material reached a temperature above the Curie temperature. If the magnetic load is non-conductive, the main source of heat generation, namely the hysteresis effect is at least reduced, if not vanished. Thus, a lower amount of heat is generated in the magnetic material than before the magnetic material reached a temperature above the Curie temperature. As the amount of energy transferred to and absorbed by the workpiece, from the magnetic load, is reduced, the (local) temperature of the workpiece (for example, local in terms of the temperature at a particular section of the workpiece) may be prevented from exceeding a critical temperature. Such critical temperature may lead to irreversible damage.

The induction heating system may be configured to heat a complete workpiece or only one or more sections of the workpiece. For example, one or more induction heating systems may be arranged in order to heat one or more sections of the workpiece. It is conceivable that one or more induction heating systems may be provided in addition to conventional heating systems, like autoclave convection heating or by direct heating using resistance heating elements or fluid elements, in order to provide local heating at the one or more sections of the workpiece.

According to a first possible realization of the induction heating system according to the first aspect, the induction heating system may further comprise a metallic shield layer. The metallic shield layer is connected to the magnetic load in a heat-conducting manner and is connectable to the workpiece in a heat-conducting manner so as to transfer the generated heat to the workpiece. The metallic shield layer may be formed between the workpiece and the magnetic load. The metallic shield layer may be formed of a conductive or highly conductive material, e.g., copper or the like.

The metallic shield layer may be configured and arranged to shield the workpiece from the alternating magnetic field. This may be achieved, for example, by arranging the metallic shield layer between the workpiece and the magnetic load. The metallic shield layer may have a higher thermal conductivity than the magnetic material of the magnetic load. Due to the higher thermal conductivity (larger thermal diffusivity), the metallic shield layer may support heat distribution from the magnetic load to the workpiece. Further, the metallic shield layer may improve the uniformity of temperature distribution.

The control unit may be configured to derive at least one of the process temperature and the temperature of the magnetic material from an electrical quantity. The electrical quantity may be dependent on the temperature of the magnetic material. For example, the electrical quantity may be the alternating current supplied to the inductor, an alternating voltage for providing the alternating current, the phase between the alternating current and the alternating voltage, and/or a mutual inductance between the inductor and the magnetic load. In case the alternating current is used as the electrical quantity, the control unit may be configured to sense or measure the current level of the alternating current. For example, a current sensor may be used to measure the current level. In the simplest form, a resistor may be used as a current sensor. From the sensed or measured level of the alternating current, the control unit may derive the process temperature and/or the temperature of the magnetic material.

According to another example, the electrical quantity may be the mutual inductance between the inductor and the magnetic load. In case the mutual inductance is used as the electrical quantity, the control unit may be configured to measure or calculate the mutual inductance, e.g., by sensing the alternating current flowing through the inductor. From this current, the control unit may calculate the mutual inductance. From the calculated mutual inductance, the control unit may derive the process temperature and/or the temperature of the magnetic material. Likewise, the alternating voltage or the phase between the alternating current and the alternating voltage may be used for deriving the process temperature and/or the temperature of the magnetic material.

The control unit may be configured to derive the temperature of the magnetic material directly from the electrical quantity. In case the electrical quantity is dependent on the temperature of the magnetic material, the control unit may be configured to compare the measured or calculated electrical quantity with a predetermined relationship between the used electrical quantity and the temperature of the magnetic material.

In order to derive the process temperature from the electrical quantity (e.g., the alternating current or the mutual inductance), the control unit may be configured to derive the temperature of the magnetic material from the electrical quantity (e.g., the alternating current or the mutual inductance). As the alternating current and the mutual inductance are dependent on the temperature of the magnetic material (likewise, the alternating voltage and the phase between the alternating current and the alternating voltage can be dependent on the temperature of the magnetic material), the control unit may be configured to derive the temperature of the magnetic material from said dependency (relationship). The control unit may be further configured to derive, from the temperature of the magnetic material, the process temperature by considering a further dependency (relationship) between the temperature of the magnetic material and the process temperature.

Independent of how the temperature of the magnetic material is derived by means of the control unit, the control unit may consider the derived temperature of the magnetic material in order to control the process temperature. For example, the control unit may be configured to determine whether the derived temperature of the magnetic material lies within the temperature control range. If the derived temperature of the magnetic material does not lie within the temperature control range, the control unit may be configured to refrain from controlling or adjusting the alternating magnetic field. If, however, the derived temperature of the magnetic material lies within the temperature control range, the control unit may be configured to appropriately adjust the alternating magnetic field.

In one specific possible implementation, the control unit may be configured to derive the process temperature from the determined electrical quantity by considering a first predetermined relationship between the temperature of the magnetic material and the electrical quantity and a second predetermined relationship between the process temperature and the temperature of the magnetic material. One or more of said first and second relationships may have been predetermined and may be stored in the induction heating system. It is conceivable that one or more of said first and second relationships may have been predetermined in a calibration process as one or more calibration curves and may be stored in the induction heating system as one or more calibration curves. For example, the induction heating system may comprise a storage unit configured to store at least one of the predetermined relationships, e.g., the calibration curves.

According to second possible realization, which may be realized independent from or in combination with the first possible realization of the induction heating system according to the first aspect, the control unit may be configured to control the process temperature by adjusting the electrical quantity. The electrical quantity used for adjusting the process temperature may be the same as or may be different from the electrical quantity used for deriving the process temperature. For example, the control unit may be configured to derive the process temperature from the mutual inductance and may be configured to control the process temperature by adjusting the alternating current. It is conceivable that the control unit derives, from the mutual inductance, that the process temperature is too high (higher than the desired process temperature). In this case, the control unit may increase the alternating current and thereby the alternating magnetic field to such a level that the alternating magnetic field heats the magnetic material to a temperature above its Curie temperature. In response thereto, the heat generated by the magnetic material is reduced because the hysteresis effect is at least decreased above the Curie temperature. Alternatively, the control unit may decrease the alternating current and thereby the alternating magnetic field to such a level that the alternating magnetic field heats the magnetic material to a lower temperature below its Curie temperature.

The alternating magnetic field may be adjusted to such a level that the magnetic material is heated, within the temperature control range, below its Curie temperature or above its Curie temperature or at its Curie temperature. In this way, the control unit may also set the alternating magnetic field to such a level (e.g., by adjusting the alternating current) that it causes the magnetic material to be heated to a temperature around (i.e., within the temperature control range), e.g., above or below or at the Curie temperature. If, for example, the control unit derives, e.g., from the mutual inductance, that the process temperature is too low (lower than the desired process temperature), the control unit may increase the alternating current and thereby the alternating magnetic field to such a level that the alternating magnetic field heats the magnetic material to an appropriate temperature below its Curie temperature and within the temperature control range. In consequence, the heat generated by the magnetic material may be increased because of the (additional) hysteresis effect of the magnetic material below the Curie temperature.

Independent of the exact realization of the control procedure, the control unit may be configured to control the process temperature for manufacturing the workpiece by repeatedly, e.g., continuously, adjusting the alternating magnetic field. This may be done by repeatedly, e.g., continuously, adjusting the electrical quantity. For example, the alternating magnetic field may be adjusted at a control cycle of one or several milliseconds up to one second. Just to give some examples, without limitation, the alternating magnetic field may be adjusted every 5 ms, every 10 ms, every 50 ms or every 100 ms.

Independent of the precise control cycle, the control cycle (i.e., the interval between adjustments(s) of the alternating magnetic field) may be dependent on the magnetic material, e.g., the type of and/or properties of the magnetic material. The properties of the magnetic material may be or comprise the thermal conductivity of the magnetic material. For example, in case of a first magnetic material having a first thermal conductivity, a first control cycle (e.g., 100 ms) may be used. In case of a second magnetic material having a second thermal conductivity higher than the first thermal conductivity, a second control cycle (e.g., 10 ms) may be used, the second control cycle being smaller than the first control cycle. In other words, the better the thermal conductivity of the magnetic material, the smaller the control cycle may be, i.e. the shorter the adjustment intervals may be.

The workpiece may be any non-conductive workpiece, for example, a carbon-fiber-reinforced polymer (CFRP) workpiece. Alternatively or additionally, the magnetic material may be a ferromagnetic or a ferrimagnetic material, for example a Nickel-alloy or the like. The magnetic material may be conductive (in which case, eddy currents can be induced by the alternating magnetic field) or non-conductive (in which case, no eddy currents can be induced by the alternating magnetic field). Alternatively or additionally, the inductor may be an induction coil or work coil. The induction coil may be formed of any conductive or highly conductive material, e.g., copper or the like. The magnetic properties of the heated ferri-/ferromagnetic material may be temperature dependent (magnetic susceptibility). This effect may be used to measure indirectly and contactlessly the temperature of the heated magnetic load and/or workpiece and thus to control the heating process. The temperature dependence of the mutual inductance between the inductor of the induction heating system and the ferri-/ferromagnetic material of the magnetic load and/or the temperature dependence of the alternating current may be regarded as the determining quantity which may be used to determine and control the induction heating process, e.g., the temperature of the induction heating process. The temperature of the magnetic load may be continuously adjusted around the curie temperature of the magnetic load within the temperature control range to the targeted process temperature.

The induction heating system may further comprise at least one of an electric insulation, a magnetic flux concentrator, and a power source or power supply. The electric insulation may be arranged between the magnetic load and the inductor. The magnetic flux concentrator may be configured and arranged to reduce the stray of the alternating magnetic field generated by the inductor. The power source or power supply may be configured to provide the alternating current.

According to a second aspect, a method for controlling a process temperature for induction heating of a workpiece is provided. The method comprises: supplying an alternating current to an inductor to generate, by the inductor, an alternating magnetic field in response thereto (i.e., to the inductor); applying the alternating magnetic field to a magnetic load comprising a magnetic material, the magnetic material having a Curie temperature, to generate heat in response to the alternating magnetic field being applied thereto (i.e., to the magnetic material), the magnetic load being connectable to the workpiece in a heat-conducting manner so as to transfer the generated heat to the workpiece; controlling, by a control unit, the process temperature by adjusting the alternating magnetic field when the temperature of the magnetic material is in a temperature control range around or below the Curie temperature of the magnetic material. The temperature control range is dependent on the magnetic material of the magnetic load.

The method may further comprise the step of deriving the process temperature from an electrical quantity, the electrical quantity being dependent on the temperature of the magnetic material.

According to a third aspect, a computer program is provided. The computer program comprises program code portions which, when it is loaded in a computer or a processor (for example a microprocessor, microcontroller or Digital Signal Processor (DSP)), or runs on a computer or processor (e.g. a microprocessor, microcontroller or DSP), causes the computer or processor (e.g. the microprocessor, microcontroller or DSP) to carry out the method described herein.

Even if some of the above-described aspects have been described herein in relation to the control unit or the induction heating system, these aspects may also be implemented as methods or as a computer program carrying out the method. In the same way, aspects described in relation to the method may be realized by suitable units or components in the control unit or the induction heating system or be carried out by the computer program.

BRIEF DESCRIPTION OF THE DRAWINGS

Specific embodiments of the present invention are explained below with reference to the appended schematic figures, in which.

DETAILED DESCRIPTION OF THE PREFERRED EMBODIMENTS

Hereinbelow, without being limited thereto, specific details are set out in order to provide a complete understanding of the present invention. It is, however, clear to a person skilled in the art that the present invention may be used in other embodiments which may deviate from the details set out below. Even if, by way of example, the embodiments hereinbelow are described with reference to certain materials to illustrate certain effects caused by these materials, the embodiments set out below are not limited thereto, but can be used without limitation with other materials providing the same or similar effects. Further, even if hereinbelow it is referred to an induction coil for generating a magnetic field, it is conceivable that other inductors may be used instead.

It is clear to a person skilled in the art that the explanations set out below are/may be implemented using hardware circuits, software means or a combination thereof. The software means may be associated with programmed microprocessors or a general computer, an ASIC (Application Specific Integrated Circuit) and/or DSPs (Digital Signal Processors). Moreover, it is clear that even if the details below are described with reference to a method, they may also be realized in a suitable device unit, a computer processor and a memory connected to a processor, the memory being provided with one or more programs which carry out the method when they are executed by the processor.

Figure 1:
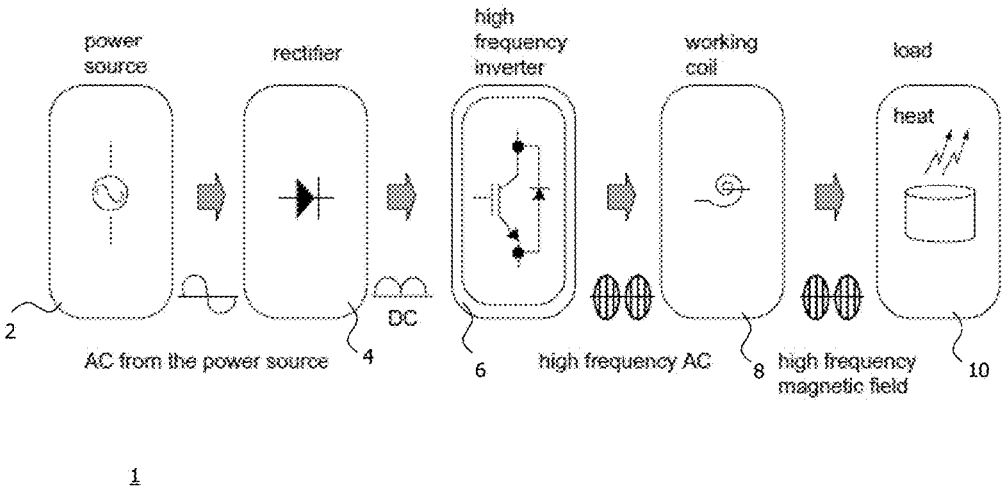
FIG. 1 shows a schematic representation of a basic structure of an induction heating system.

FIG. 1 shows a schematic representation of a basic structure of an induction heating system 1. The induction heating system 1 as shown in FIG. 1 comprises a power source 2, a rectifier 4, a high frequency inverter 6, a working coil 8 and a load 10.

The load 10 may be the workpiece to be heated, in which case the induction heating system 1 may be regarded as a direct induction heating system, i.e., an induction system in which the workpiece is directly heated by means of a magnetic field. Alternatively, the load 10 may be a susceptor, in which case the induction heating system 1 may be regarded as an indirect induction heating system, i.e., an induction heating system in which the susceptor is (directly) heated by means of a magnetic field and transfers the generated heat to a workpiece, which is connected to the susceptor in a heat-conducting manner. In the latter case, the workpiece is indirectly heated by the magnetic field.

The power source 2 may be any power source configured to provide or generate alternating current. As can be schematically seen from FIG. 1, the power source 2 is directly or indirectly connected to a rectifier 4 so as to supply the generated alternating current to the rectifier 4. The rectifier 4 is configured to rectify the alternating current so as to convert the alternating current to direct current. The rectifier 4 is directly or indirectly connected to a high frequency inverter 6 and can thereby supply the direct current to the high frequency inverter 6. The high frequency inverter 6 comprises a high frequency switching circuit to administer high frequency alternating current to the working coil 8 (which may also be called induction coil or heating coil) as a possible realization for an inductor. According to ampere's law, a high frequency magnetic field is created around the working coil in response to the high frequency alternating current being applied thereto. Further, the magnetic field in space around the electric current is proportional to the electric current which serves as its source. Instead of a high frequency inverter, a medium frequency inverter or the like may be used to generate an alternating current having a medium frequency, e.g., between 20 and 100 kHz.

In the following, it is assumed by way of example for explanation rather than limitation that the load 10 is conductive. If the conductive load 10 (which may be a conductive workpiece or a susceptor) is put inside the high frequency magnetic field, as schematically shown in FIG. 1, eddy currents are induced within the load 10. The eddy currents generate thermal energy within the load 10 and increase the temperature of the load 10 during the heating process.

If the load 10 is (also) magnetic, (additional) heat is generated due to the so called hysteresis effect (or hysteresis loss). The most important reason for this kind of effect or loss is the movement of the domain walls within the magnetic material of the load 10. In this respect, the area around the hysteresis loop is a direct measure of the magnetic hysteresis energy which has to be applied in order to reverse the magnetization and corresponds to the energy irreversibly transformed into heat during one magnetization cycle. FIG.

3B shows, by way of example, three hysteresis loops (B-H curves) for three different frequencies, namely 6 Hz, 49 Hz and 90 Hz.

Specific details will in the following by described with respect to the inductor and the load of an induction heating system 1. At least a subset of these details may be implemented with the power source 2, the rectifier 4 and the high frequency converter 6 of FIG. 1, but these details are not limited thereto. In other words, the specific details set out below may be implemented with every conceivable type of power source which is configured to provide an alternating current.

Figure 2:
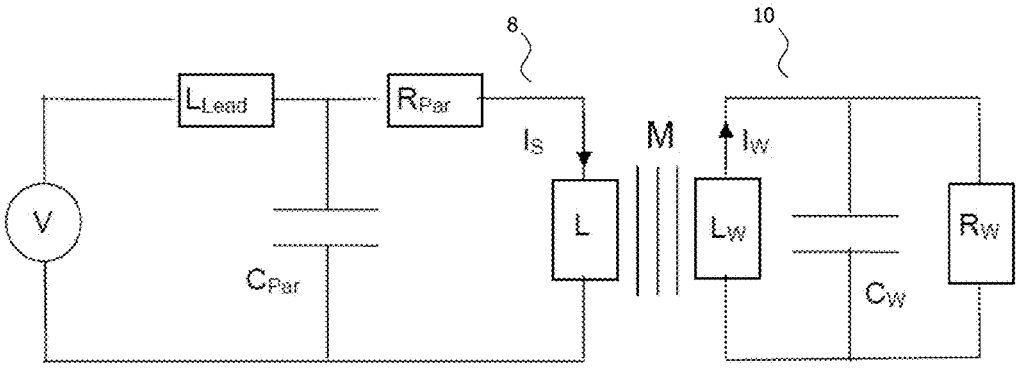
FIG. 2 shows a schematic representation of an equivalent circuit of the induction coil and the load/workpiece of FIG. 1.

FIG. 2 shows a schematic representation of an equivalent circuit of the induction coil 8 and the load 10 of FIG. 1. By way of example it is assumed in FIG. 2 that the load 10 is an electrically conductive and magnetic workpiece. Therefore, it will be referred to the load/workpiece 10 in FIG. 2. Likewise, it is in the following interchangeably referred to the heating coil 8, working coil 8, heating coil 8 or just, in short, coil 8, which actually refers the same kind of inductor.

As can be seen from FIG. 2, this part of the induction heating system 1, namely the working coil (induction coil) 8 and the load/workpiece 10, may be regarded as similar to that of the theory of a transformer. In consequence, the equivalent circuit comprises such a transformer. In short, when an alternating electrical current is applied to the primary of a transformer, an alternating magnetic field is created. According to Faraday's Law, if the secondary of the transformer is located within the magnetic field, an electric current will be induced.

In the present example, the primary current of the transformer is the source coil current (the current through the working coil 8; the source coil current may also be referred to as coil current and source current, which terms are used interchangeably in the following), IS, where the secondary current, IW, is the induced eddy current of the load/workpiece 10, as described above. The primary and secondary losses are caused by the resistance of windings, RPar, and the workpiece resistance, RW, respectively. CPar is the capacitance between neighboring turns of the induction coil 8. LLead is the inductance of the attachment leads. CW is the capacitance of the load/workpiece 10 that is usually neglected in the low frequency range. The mutual inductance M is effected by such factors as the shape of the heating coil 8 and the load/workpiece 10, the distance between the coil 8 and the load/workpiece 10, the materials of the coil 8 and the load/workpiece 10 (e.g., their permeabilities and resistivities which depend on temperature), and/or the operating frequency f of the system. Thus, the mutual inductance M, which describes the magnetic coupling of the coil 8 to the load/workpiece 10, is a function of temperature. The temperature dependence of the permeability of ferri- and ferromagnetic materials around the Curie temperature reduces the magnetic coupling between the induction coil 8 and the magnetic load/workpiece 10 considerably, as can be seen in FIG. 3A.

Figure 3A:
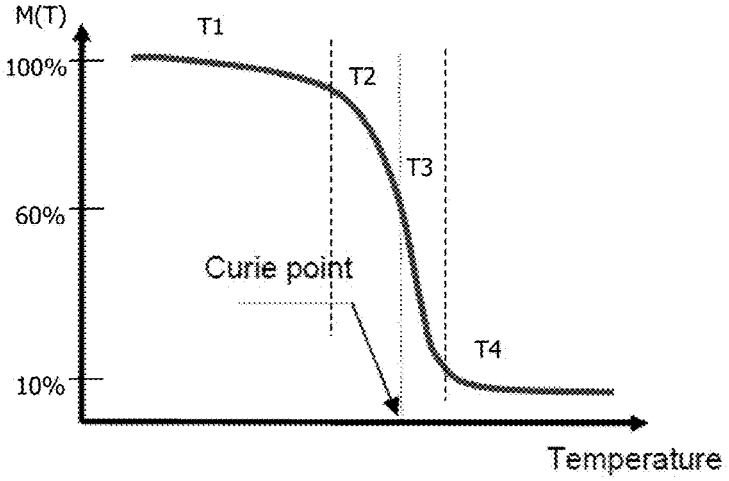
FIG. 3A schematically illustrates the temperature dependence of the mutual inductance between the induction coil and the load/workpiece of the equivalent circuit of FIG. 2.

FIG. 3A shows the mutual inductance M(T) (T: Temperature) over temperature. A curve similar to that of FIG. 3A can be given for illustrating the magnetic permeability (susceptibility) over temperature. At low temperatures, the mutual inductance (and likewise the magnetic permeability) is at its highest level, which is for sake of illustration referred to in FIG. 3A as 100%, instead of giving a precise value. With increasing temperature, the mutual inductance (and likewise the magnetic permeability) stays almost constant, i.e., nearly about 100%, in a first temperature range T1. When further increasing the temperature closer to the Curie temperature, the mutual inductance (and likewise the magnetic permeability) is decreased in a second temperature range T2 up to the Curie temperature. At the Curie temperature, the mutual inductance M (and likewise the magnetic permeability) has decreased exemplarily to a level of about 60%. When further increasing the temperature above the Curie temperature in a third temperature range T3, the mutual inductance (and likewise the magnetic permeability) is further decreased to about 10%, by way of example. Finally, a further increase in temperature does almost not change the mutual inductance (and likewise the magnetic permeability) anymore (fourth temperature range T4), i.e., the mutual inductance M (and likewise the magnetic permeability) almost stays constant.

Although FIG. 3A only qualitatively rather than quantitatively illustrates the temperature dependence of the mutual inductance (and likewise the magnetic permeability), it becomes evident that in the temperature ranges T2 and T3 around the Curie temperature, a slight change in temperature causes a big change in the mutual inductance M. The temperature range formed by the temperature ranges T2 and T3 may be referred to herein as the temperature control range. In this way, by determining the mutual inductance M (and likewise the magnetic permeability), the corresponding temperature can be uniquely identified. Similarly, by influencing the mutual inductance M (and likewise the magnetic permeability), the corresponding temperature can be adjusted. Because the mutual inductance M changes drastically in the temperature control range formed by the temperature ranges T2 and T3, a high resolution for deriving the temperature from the mutual inductance M (and likewise the magnetic permeability) is provided in the temperature control range, which ensures reliable control of the process temperature for manufacturing the workpiece.

Returning to FIG. 2, the coil current IS is primarily affected by the inductance L and LLead, the resistance RPar, and the capacitance CPar. It is also affected by the load/workpiece 10 through the mutual inductance M. Because the mutual inductance M depends on the temperature of the workpiece (through the temperature dependent permeability), the source current IS does also depend on temperature $$IS=IS(T)=IS(M(T))$$

In this way, by determining the coil current IS, the corresponding temperature can be uniquely identified. Likewise, by influencing the coil current IS, the corresponding temperature can be adjusted.

Figure 3B:
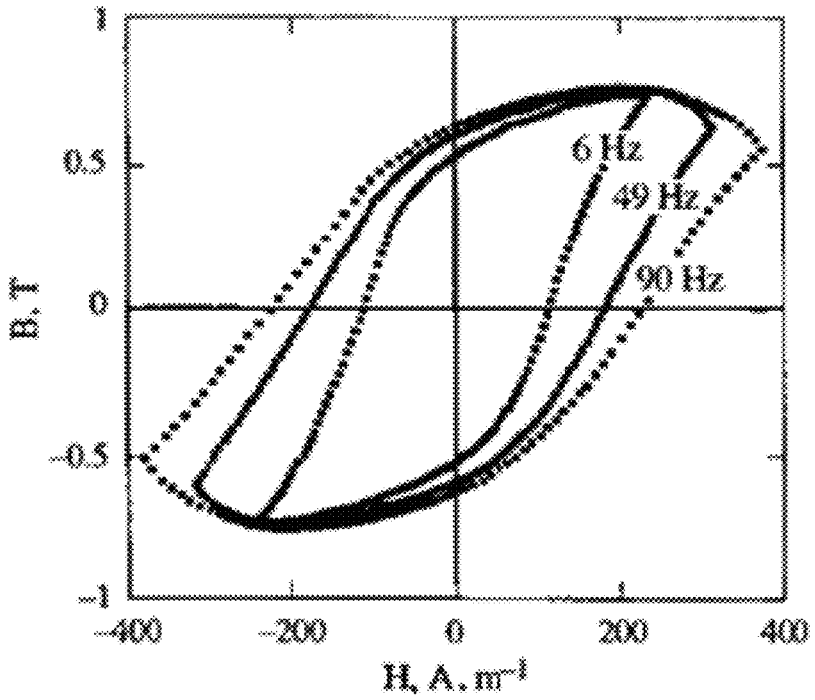
FIG. 3B schematically illustrates the hysteresis effect occurring when a magnetic workpiece is used in the induction heating system of FIG. 1.
Figure 4:
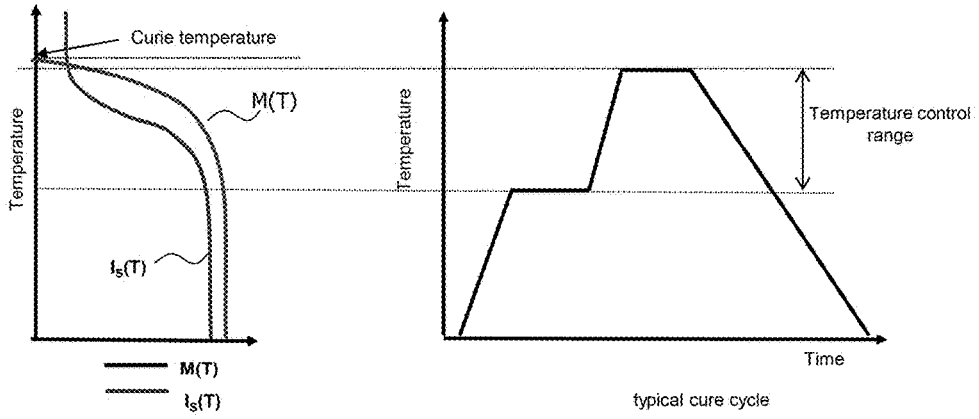
FIG. 4 schematically illustrates an example of an induction heating cycle.

FIG. 4 schematically illustrates the concept of the temperature control range in more detail by means of an exemplary curing cycle for a workpiece to be cured. In contrast to FIG. 3B, in FIG. 4, a temperature control range below the Curie temperature is chosen by way of example. The left diagram of FIG. 4 illustrates the change of the coil current IS and the mutual inductance M in dependence of the temperature of the magnetic material. As can be seen in FIG. 4, in the temperature control range (which may also be referred to as critical temperature range), a change of temperature results in a rather strong change in the coil current IS and the mutual inductance M. On the contrary, at temperatures below the temperature control range, the coil current IS and the mutual inductance M remain at least almost constant. Further, at temperatures above the temperature control range, the coil current IS remains at least almost constant. In consequence, within the temperature control range, the temperature of the magnetic material can be precisely derived from the coil current IS and/or the mutual inductance M. Further, within the temperature control range, a change in the coil current IS and/or the mutual inductance M leads to a change of the temperature of the magnetic material and thus the temperature of the magnetic material can be controlled within the temperature control range by adjusting the coil current IS and/or the mutual inductance M.

As can be further seen in the right diagram of FIG. 4, as time increases, the temperature of the magnetic material increases until it reaches a lower end of the temperature control range. When the temperature of the magnetic material reaches the lower end of the temperature control range, the temperature control is started. As exemplarily illustrated in FIG. 4, the temperature is controlled such that it remains constant for a certain time. This may be done by reducing the coil current IS and/or the mutual inductance M. Then, the temperature is increased to an upper end of the temperature control range. This may be done by increasing the coil current IS and/or the mutual inductance M. In the present example, the temperature of the magnetic material is repeatedly determined, e.g. derived from the coil current IS and/or the mutual inductance M. When it is determined that the upper end of the temperature control range is reached, the temperature is kept at a constant level and is then reduced. This may be done by lowering the coil current IS and/or the mutual inductance M. When the temperature finally passes the lower end of the temperature control range, the temperature control is ceased as the curing process is finished.

Figure 5A:
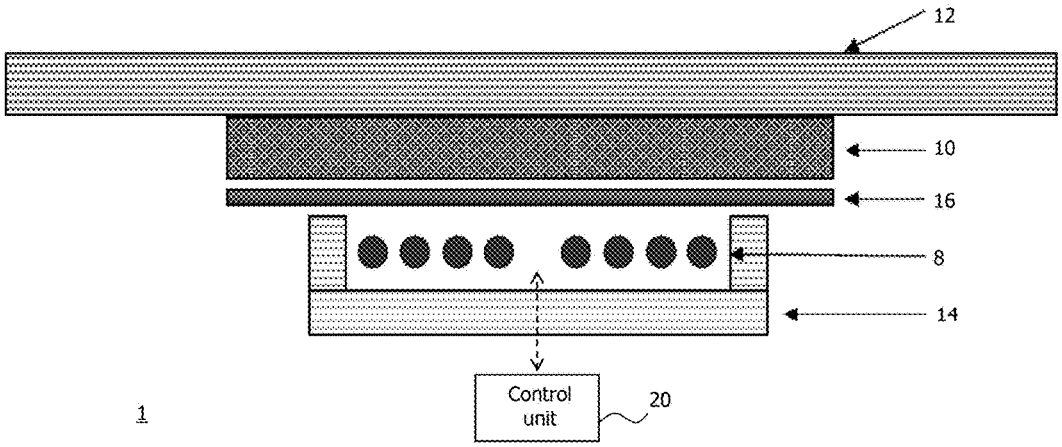
FIG. 5A schematically illustrates a cross section of an induction heating system according to a first device embodiment.
Figure 5B:
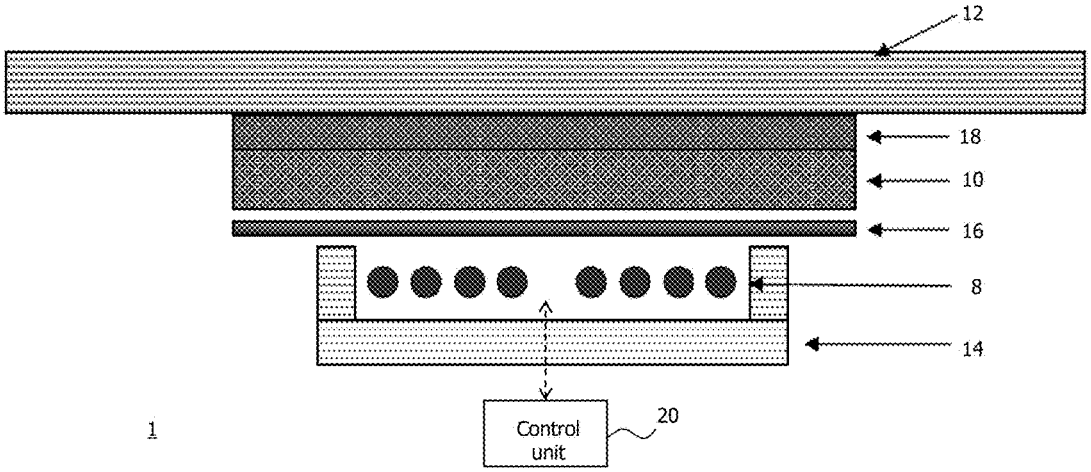
FIG. 5B schematically illustrates a cross section of an induction heating system according to a second device embodiment.

FIGS. 5A and 5B schematically illustrate, respectively, a cross section of an induction heating system 1 according to a first device embodiment (FIG. 5A) and a second device embodiment (FIG. 5B). No power supply is shown in FIGS. 5A and 5B, as the embodiments shown in FIGS. 5A and 5B may be realized with any type of power supply which is configured to provide an alternating current. Purely by way of example and without limitation, the power source 2, the rectifier 4 and the high frequency inverter 6 of FIG. 1 may serve as a suitable power supply for the embodiments shown in FIGS. 5A and 5B. Further, schematically, a control unit 20 is shown in FIGS. 5A and 5B. Still further, the same reference signs as used in FIG. 1 will be used in the following for the coil and the magnetic load 10 of FIGS. 5A and 5B, as the details described below with respect to FIGS. 5A and 5B may be suitably applied to the arrangement of FIG. 1.

The induction heating system 1 of the first device embodiment as shown in FIG. 5A comprises an induction coil 8 as an inductor, a magnetic flux converter (magnetic flux concentrator) 14 made from ferrite materials with high Curie temperature, an electric insulation layer 16, and a magnetic load 10. The magnetic flux converter 14 is arranged below the coil 8 and screened on the back side by aluminum. A planar workpiece 12 may be placed on the magnetic load 10 as illustrated in FIG. 5A. The coil 8 is, in the exemplary embodiment of FIG. 5A, a spiral planar coil which is fed by a medium-frequency (20-100 KHz) power source. According to Faraday's law the alternating magnetic field generates heat by inducing eddy currents in the magnetic load 10 and, additionally, in ferrimagnetic materials, which is used in the present example for the magnetic load 10 (likewise ferromagnetic materials may be used for the magnetic load 10) by generating hysteresis losses and possibly excess losses. All of these losses heat up the magnetic load 10 during the induction heating process. Ferrite is located under the coil 8 as a magnetic flux concentrator 14 to reduce the stray effects of the magnetic field and to shield and protect the electronic control system which may comprise or be configured as the control unit 20 and which may be placed under the applicator as shown in FIG. 5A.

The function of the heated (magnetic) load 10 may be to support conventional heating of the workpiece 12, for example, of a CFRP workpiece. The induction heating elements may be placed on special selected areas, in order to control the process temperature on demand locally as required by the particular shape and structure of the workpiece 12, e.g., the CFRP workpiece.

The second device embodiment as shown in FIG. 5B additionally comprises a metallic shield layer 18. In the second device embodiment, the metallic shield layer 18 is arranged between the workpiece 12 and the magnetic load 10. Further, instead of ferrimagnetic materials, ferromagnetic materials are used for the magnetic load 10 in the second device embodiment of FIG. 5B. The further elements correspond to those of the first device embodiment of FIG. 5A.

As stated above, in the second device embodiment, an additional high conducting metallic layer (for example, made of copper) 18 is placed between the magnetic load 10 and the workpiece 12, e.g., the CFRP workpiece. This additional metallic layer 18 supports the heat conduction from the magnetic load 10 and improves the uniformity of the temperature distribution due to larger thermal diffusivity of the metallic layer 18 than that of the ferromagnetic materials of the magnetic load 10. Moreover, this metallic layer 18 shields the magnetic field generated by the coil 8. The shielding effect may be highest, for example, for temperatures around and above the Curie temperature and may thus prevent the local induction heating of the workpiece 12, e.g., the CFRP workpiece, by minimizing the effect of the magnetic stray field. For example, without the shielding effect of the metallic layer 18, the magnetic field may not only be confined within the ferri- or ferromagnetic material of the magnetic load 10, but may also stray into the workpiece 12. This may be prevented by the metallic layer 18.

Further, as stated above, ferromagnetic materials are used for the magnetic load 10 in the second device embodiment of FIG. 5B. Since the induction heating efficiency of ferromagnetic materials is generally higher than that of ferrimagnetic materials, ferromagnetic materials like nickel or nickel-alloys which have higher thermal and electrical conductivity than ferrimagnetic materials are used in the second device embodiment for the magnetic load 10. Just to give an example, the Curie temperature of nickel is around 628 K. Further, in case of nickel there is a temperature control range of around 170 K where the magnetization decreases strongly with increasing temperature. Moreover, the ferromagnetic materials have higher values of thermal conductivity (diffusivity) than ferrimagnetic materials. This enhances greatly the heat transfer from the heated magnetic load 10 to the workpiece 12, e.g., the CFRP workpiece. It is also conceivable that ferromagnetic materials are used in the first device embodiment of FIG. 5A and ferrimagnetic materials are used in the second device embodiment of FIG. 5B.

In both embodiments, the source current dependence on the mutual inductance can be used. Thus, in both embodiments the temperature dependence of the source current and/or the mutual inductance can be used. In other words, it can be considered that the permeability of the magnetic load 10 is temperature dependent. For example, in the temperature control range formed by temperature ranges T2 and T3 as shown in FIG. 3A, the mutual inductance and thus the permeability of the magnetic load 10 is highly dependent on the temperature, as described in detail above.

That is, the temperature dependence of the source current (coil current), IS, upon the temperature dependence on the mutual inductance M may be used. In this context, it can be assumed that there is a measurable change of mutual inductance M and thus of source current around the Curie temperature (see FIG. 3A). For an active temperature control around the Curie temperature, the calibration of the source current (magnitude and phase) to the workpiece temperature and the magnetic load temperature may be necessary. For example, it is possible that one or more calibration curves are determined before the actual heating process. These one or more calibration curves may provide, respectively, the relationship of the source current IS and/or of the mutual inductance M to the temperature of the magnetic load 10. Alternatively or additionally, the one or more calibration curves may provide, respectively, the relationship of the source current IS and/or of the mutual inductance M to the temperature of the workpiece 12 (process temperature). The calibration curves may then be stored in the control unit 20 and may be used by the control unit 20 to derive the temperature of the magnetic load 18 and/or the process temperature from the source current IS and/or the mutual inductance M.

The embodiments shown in FIGS. 5A and 5B have the advantage that the temperature of the magnetic load 10 (and, in case of the second device embodiment of FIG. 5B, also of the conducting metallic shield 18) can be continuously adjusted around or below the Curie temperature of the magnetic load 10 to the desired process temperature of the manufactured workpiece 12, e.g., the manufactured CFRP workpiece or CFRP parts.

Figure 6:
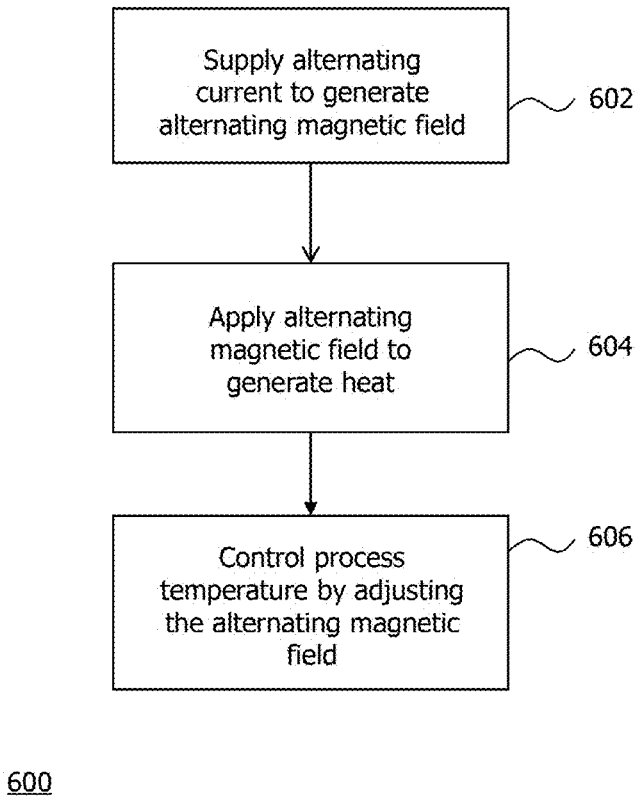
FIG. 6 schematically illustrates a flow diagram of a method embodiment.

A method embodiment is shown in the flow diagram of FIG. 6. According to the method embodiment, an alternating current is supplied (step 602) to an inductor, e.g., the induction coil 8. In response thereto, the inductor, e.g., the induction coil 8, generates an alternating magnetic field.

Then, in step 604, the alternating magnetic field is applied to the magnetic load 10 comprising a magnetic material, e.g., a ferri- or ferromagnetic material. The magnetic material has a Curie temperature. Heat is generated in response to the alternating magnetic field being applied to the metallic material. The magnetic load 10 is connectable to the workpiece 12 in a heat-conducting manner so as to transfer the generated heat to the workpiece 12.

In step 606 the control unit 20 controls the process temperature for manufacturing the workpiece by adjusting the alternating magnetic field. The control unit 20 may be configured to derive the required level, at which it heats the magnetic material to a temperature within the temperature control range from a calibration curve as mentioned above. Repeatedly, e.g., continuously, the control unit 20 may determine the current process temperature and may adjust the process temperature again by adjusting the alternating magnetic field. This may be done by adjusting the source coil current IS. In order to determine the current process temperature, a calibration curve providing the relationship between the process temperature and a temperature dependent electrical quantity, e.g., the mutual inductance M, may be considered. On the basis of the current process temperature, the alternating magnetic field may be set to the required level, as derived from a calibration curve and so on.

The alternating magnetic field may be set at different levels depending on the current process temperature. The alternating magnetic field may be set, by the control unit 20, to any desired level, at which it heats the magnetic material to a temperature within the temperature control range, e.g., to a temperature above the Curie temperature, below the Curie temperature or even to the Curie temperature.

By means of the above described embodiments one can expect shorter manufacturing time, e.g., shorter curing time, and less energy consumption for manufacturing, e.g., curing for serial production. Shorter processes are keys for high productivity, which may thereby be increased. The induction heating system may be used as a stand-alone system or in combination with autoclave systems. Furthermore, the embodiments enable an active process control of the temperature. In addition, the temperature of the heated load and/or workpiece may be determined contactless, which may lead to one or more of the following advantages: fast temperature determination, no influence of temperature determination by external or internal measurement devices, a temperature determination which is independent of the size and shape of the potential geometries, and an automatic (active) process control.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. An induction heating system for controlling a process temperature for induction heating of a workpiece, the induction heating system comprising:

an inductor configured to generate an alternating magnetic field in response to an alternating current supplied thereto;

a magnetic load comprising a magnetic material, the magnetic material having a Curie temperature and being configured to generate heat in response to the alternating magnetic field being applied thereto, the magnetic load being connectable to the workpiece in a heat-conducting manner so as to transfer the generated heat to the workpiece; and a control unit configured to control the process temperature by adjusting the alternating magnetic field when the temperature of the magnetic material is in a temperature control range around or below the Curie temperature of the magnetic material, wherein the control unit is further configured to adjust a variable size of the temperature control range dependent on the magnetic material of the magnetic load, wherein the control unit is further configured to refrain from controlling the process temperature, when the temperature of the magnetic material is outside the temperature control range, and wherein the temperature control range is defined by a range in which a change of magnetic permeability of the magnetic material over temperature is higher than a predetermined value.

2. The induction heating system of claim 1, wherein the induction heating system further comprises a metallic shield layer connected to the magnetic load in a heat-conducting manner and connectable to the workpiece in a heat-conducting manner so as to transfer the generated heat to the workpiece.

3. The induction heating system of claim 2, wherein the metallic shield layer is configured and arranged to shield the workpiece from the alternating magnetic field.

4. The induction heating system of claim 2, wherein the metallic shield layer has a higher thermal conductivity than the magnetic material of the magnetic load.

5. The induction heating system of claim 1, wherein the control unit is configured to derive at least one of the process temperature and the temperature of the magnetic material from an electrical quantity, the electrical quantity being dependent on the temperature of the magnetic material.

6. The induction heating system of claim 5, wherein the electrical quantity is the alternating current supplied to the inductor, an alternating voltage for providing the alternating current, a phase between the alternating current and the alternating voltage, or a mutual inductance between the inductor and the magnetic load.

7. The induction heating system of claim 5, wherein the control unit is configured to derive the process temperature from the determined electrical quantity by considering a first predetermined relationship between the temperature of the magnetic material and the electrical quantity and a second predetermined relationship between the process temperature and the temperature of the magnetic material.

8. The induction heating system of claim 7, wherein the induction heating system comprises a storage unit configured to store at least one of the predetermined relationships.

9. The induction heating system of claim 5, wherein the control unit is configured to control the process temperature by adjusting the electrical quantity.

10. The induction heating system of claim 1, wherein the control unit is configured to control the process temperature by continuously adjusting the alternating magnetic field.

11. The induction heating system of claim 1, wherein the control unit is configured to control the process temperature at a control cycle, the control cycle being dependent on the magnetic material.

12. The induction heating system of claim 1, wherein the workpiece is a carbon-fiber-reinforced polymer (CFRP) workpiece.

13. The induction heating system of claim 1, wherein the induction heating system further comprises at least one of: an electric insulation arranged between the magnetic load and the inductor; a magnetic flux concentrator configured and arranged to reduce the stray of the alternating magnetic field generated by the inductor; and a power source or power supply configured to provide the alternating current.

14. The induction heating system of claim 1, wherein the magnetic material is a ferromagnetic or a ferrimagnetic material.

15. The induction heating system of claim 1, wherein the magnetic material is a Nickel-alloy.

16. The induction heating system of claim 1, wherein the inductor is an induction coil.

17. A method for controlling a process temperature for induction heating of a workpiece, the method comprising:

supplying an alternating current to an inductor to generate, by the inductor, an alternating magnetic field in response thereto;

applying the alternating magnetic field to a magnetic load comprising a magnetic material, the magnetic material having a Curie temperature, to generate heat in response to the alternating magnetic field being applied thereto, the magnetic load being connectable to the workpiece in a heat-conducting manner so as to transfer the generated heat to the workpiece;

controlling, by a control unit, the process temperature by adjusting the alternating magnetic field when the temperature of the magnetic material is in a temperature control range around or below the Curie temperature of the magnetic material;

adjusting, by the control unit, a variable size of the temperature control range dependent on the magnetic material of the magnetic load; and refraining, by the control unit, from controlling the process temperature, when the temperature of the magnetic material is outside the temperature control range, and wherein the temperature control range is defined by a range in which a change of magnetic permeability of the magnetic material over temperature is higher than a predetermined value.

18. The method of claim 17, wherein the method further comprises deriving the process temperature from an electrical quantity, the electrical quantity being dependent on the temperature of the magnetic material.

19. An induction heating system for controlling a process temperature for induction heating of a workpiece, the induction heating system comprising:

an inductor configured to generate an alternating magnetic field in response to an alternating current supplied thereto;

a magnetic load comprising a magnetic material, the magnetic material having a Curie temperature and being configured to generate heat in response to the alternating magnetic field being applied thereto, the magnetic load being connectable to the workpiece in a heat-conducting manner so as to transfer the generated heat to the workpiece; and a control unit configured to control the process temperature by adjusting the alternating magnetic field when the temperature of the magnetic material is in a temperature control range entirely below the Curie temperature of the magnetic material, the temperature control range being dependent on the magnetic material of the magnetic load, wherein the control unit is further configured to refrain from adjusting the alternating magnetic field when the temperature of the magnetic material is outside the temperature control range, and wherein the temperature control range is defined by a range in which a change of magnetic permeability of the magnetic material over temperature is higher than a predetermined value.

* * * * *